US005904285A

United States Patent [19]

Anderson et al.

[11] Patent Number: 5,904,285

[45] Date of Patent: May 18, 1999

[54] NAIL TRANSFER APPARATUS

[75] Inventors: Hugh H Anderson, Amelia; Ronald L Edwards, Richmond, both of Va.

[73] Assignee: Rayco Industries, Inc., Richmond, Va.

[21] Appl. No.: 08/979,943

[22] Filed: Nov. 26, 1997

[51] Int. Cl.[6] ..... B21J 15/10

[52] U.S. Cl. ..... 227/115; 227/117; 221/212

[58] Field of Search ..... 227/119, 120, 227/135, 137, 114, 117, 113, 115, 116, 138

[56] References Cited

U.S. PATENT DOCUMENTS

| | | | |
|---|---|---|---|
| 2,056,571 | 10/1936 | Eller et al. . | |
| 2,219,739 | 10/1940 | Duncan . | |
| 3,265,273 | 8/1966 | Janus | 227/116 |
| 3,269,514 | 8/1966 | Daniels et al. . | |
| 3,298,585 | 1/1967 | Möhrke et al. | 227/114 |
| 3,440,798 | 4/1969 | Rackley . | |
| 3,448,894 | 6/1969 | Modrey et al. . | |
| 3,765,588 | 10/1973 | Frederickson | 227/115 |
| 3,820,705 | 6/1974 | Beals . | |
| 3,908,884 | 9/1975 | Schrepferman | 227/120 |
| 4,061,094 | 12/1977 | Cary et al. . | |
| 4,256,238 | 3/1981 | Naitou et al. . | |
| 4,270,687 | 6/1981 | Maurer . | |
| 4,288,017 | 9/1981 | Russell | 227/115 |
| 4,312,472 | 1/1982 | Okunda . | |
| 4,370,093 | 1/1983 | Lund . | |
| 4,389,012 | 6/1983 | Grikis et al. . | |
| 4,416,172 | 11/1983 | Medinger . | |
| 4,487,355 | 12/1984 | Ginnow et al. . | |
| 4,503,993 | 3/1985 | Ginnow et al. | 227/117 |
| 4,593,845 | 6/1986 | Andersson et al. | 227/115 |
| 5,009,354 | 4/1991 | D'Aquila et al. | 227/117 |
| 5,193,729 | 3/1993 | Dewey et al. . | |
| 5,437,404 | 8/1995 | Shkolnikov | 227/120 |
| 5,478,002 | 12/1995 | Clement et al. . | |
| 5,495,973 | 3/1996 | Ishizawa et al. | 227/8 |
| 5,687,624 | 11/1997 | Tsuge et al. | 227/120 |

*Primary Examiner*—Jessica J. Harrison
*Assistant Examiner*—John Paradiso
*Attorney, Agent, or Firm*—Millen, White, Zelano & Branigan, P.C.

[57] ABSTRACT

An improved nail transfer device includes an inlet and an outlet with a transfer passage disposed therebetween. A cycling indexer transfers nails one at a time from the inlet to the outlet. A first magnet draws a nail from the inlet to the transfer passage and a second magnet adjacent to the outlet dislodges the nails from the transfer passage and loads the nail into the automatic nail gun.

19 Claims, 4 Drawing Sheets

NAIL TRANSFER APPARATUS

BACKGROUND OF THE INVENTION

This invention relates generally to an improved nail transfer apparatus for use in connection with high-speed nail guns. The disclosed invention may efficiently transfer bulk nails in high speed applications where reliability of transfer is required.

Automatic nail guns are commonly used in the building and manufacturing industries. Typically through pneumatic actuation, a large number of nails are driven quickly into a work surface. For many nail gun applications, a gravity feed mechanism is sufficient to feed nails into a nail gun. In these devices, nails are fed by a tube or magazine into the nail gun by gravity. The limitations include the speed at which gravity feeds the nails and the reliability of having a nail in position to be loaded into the nail gun. Alternatively, the nails may be spring loaded into a magazine. In this way, the nails are pushed towards the firing chamber in the gun by a spring. This alternative results in down time of the gun when the magazine is switched out or reloaded.

For high speed applications, gravity feed or spring loaded mechanisms may not be effective. A gravity feed nail source may not be fast enough, and the spring load nail source may cause disruptions since it must be regularly reloaded. The solution to these problems has been to attach the nails together. For instance, a long row of nails may be tacked directly to each other into "sticks " of nails. Alternatively, there are collated nails in which the nails are tacked to a wire in a long coil. In either case, nails can be transferred and drawn quickly and reliably into the firing chamber of the nail gun.

Functionally, the use of collated nails or sticks of nails is effective. Economically, however, these nails are relatively more expensive than bulk or loose nails. For high volume manufacturing applications such as pallet making, the cost of nails can be substantial. Also, in each case, the source of nails must be periodically reloaded with a magazine of connected nails. Whenever reloading is required, the manufacturing process must be temporarily suspended.

SUMMARY OF THE INVENTION

It is a feature of the present invention to overcome the foregoing drawbacks and provide a device for transferring bulk nails in a reliable and rapid manner. The device may be used to feed bulk nails into an automatic nail gun or otherwise efficiently to transfer bulk nails from a source to a separate destination. This and other features will be evident from the specification, drawings and appended claims in this application.

The invention is directed to a nail transfer device for transferring nails from a nail gun source to an automatic nail gun. The device comprises an inlet and an outlet with a transfer passage disposed therebetween, and a cycling indexer for transferring nails one at a time from with the inlet to the outlet. A first magnet draws the nails from the inlet to the transfer passage, and a second magnet adjacent to the outlet dislodges the nails from the transfer passage and loads the nail into the automatic nail gun.

In one embodiment, the present invention describes an automatic nail gun comprising a nail source, a nail head and a nailing mechanism. The nail head is made of a hollow cylinder disposed between the nail source and nailing mechanism. A cylindrical turret is mounted inside the cylinder. The cylinder further comprises an inlet and an outlet wherein the inlet is an opening that is in communication with the nail source and allows the movement of nails from the nail source into the cylinder. The outlet is an opening that is in communication with the nailing mechanism and allows the movement of nails from inside the cylinder into the nailing mechanism. The turret is rotatable inside the cylinder and has an outside diameter that defines notches adapted to carry nails. A first magnet is mounted within the outside diameter of the turret and adjacent the inlet. A second magnet is mounted in the nailing mechanism and adjacent the outlet. The second magnet is stronger than the first magnet so that a nail otherwise retained in the turret by the first magnet is drawn off of the turret by the second magnet into the nailing mechanism. A cycling indexer actuates the rotation of the turret so that a single nail at a time will be drawn into the nail transfer mechanism from the nail source and another single nail at a time will be drawn into the nailing mechanism from the nail transfer mechanism.

In another embodiment, the invention may be described as a nail transfer device for transferring nails from a nail source to an automatic nail gun. The device comprises an inlet for receiving nails from the source and an outlet adapted to dispense nails to the automatic gun. A transfer passage is disposed between the inlet and the outlet, the transfer passage having an individual nail holding station for receiving one nail at a time from the inlet. A retainer releasably holds a nail to the nail holding station with a first force of a selected magnitude. The device further includes a cycling indexer for transferring a nail from the nail holding station to the outlet. The device further includes an extractor at the outlet exerting a second force on the nail, the second force being sufficient to remove the nail from the transfer passage and through the outlet for dispensing to the automatic nail gun. The transfer passage may be comprised of a turret rotatable about an axis and have a plurality of nail holding stations. The retainer and extractor may be comprised of a first and second magnetic materials respectively.

DETAILED DESCRIPTION OF PREFERRED EMBODIMENTS OF THE INVENTION

The invention will now be described in terms of preferred embodiments. Specifically, the nail transfer device will be described in the context of its use in feeding bulk nails to an automatic nail gun. The nail transfer device may be used for other purposes where it is necessary to separate and dispense nails in a reliable and efficient manner.

Figure 1:
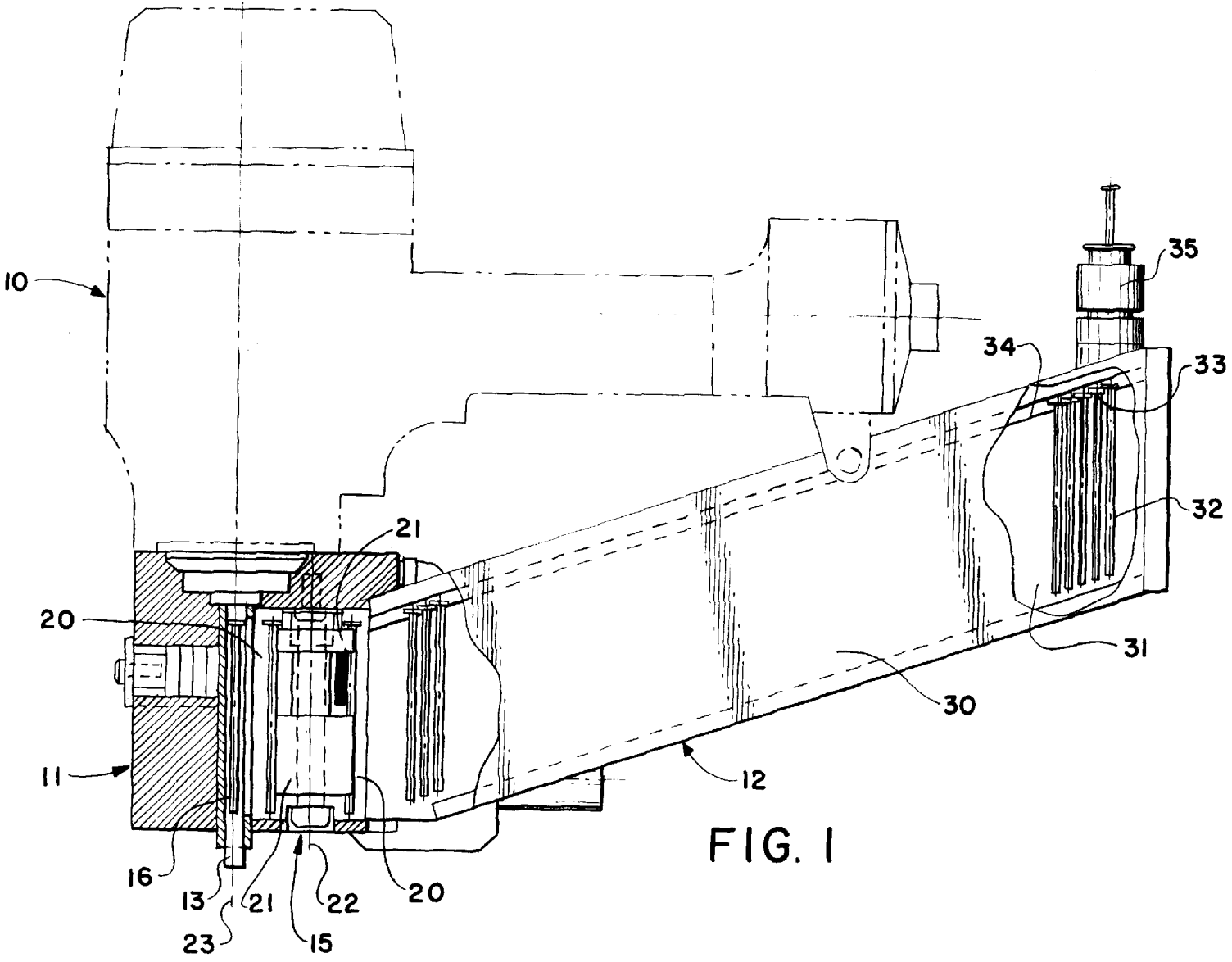
FIG. 1 is a side elevation view including a partial cross-section of one embodiment of the present invention.

Turning now to FIG. 1, there is shown in phantom lines a conventional pneumatically operated automatic nail gun 10. This automatic nail gun 10 is connected to a nail head 11 which is in turn connected to a nail source 12. The automatic nail gun 10 shown is a commercially available unit from, for instance, Stanley-Bostitch. Operation and maintenance of many types of automatic nail guns are known to those of skill in the art. The present invention may be adapted to be used in conjunction with any automatic nail gun.

The nail head 11 shown in FIG. 1 is a single, integral unit that is made up of both the firing chamber 13 of the gun and the nail transfer device 15. The firing chamber and transfer device may also be designed as separate components. In this illustration, a nail 16 is positioned within the firing chamber 13 waiting to be discharged. Next to the firing chamber 13, and in communication therewith, is a hollow cylinder 20. A turret 21 is mounted within the hollow cylinder 20. The turret 21 is generally cylindrical in shape having a dimension selected so that it fits within the hollow cylinder and may rotate about its central, longitudinal axis 22 when mounted in the cylinder. The longitudinal axis 22 of the turret 21 is parallel to the central, longitudinal axis 23 of the firing chamber.

Next to and connected to the head 11 is the nail source 12. As shown, the nail source 12 is a tubular body 30 with a longitudinal slot 31 through its length that carries nails 32 by supporting the heads 33 of the nails along a longitudinal pair of parallel guideways 34 defined by the longitudinal slot in the nail source. The nail source 12 is also commonly referred to as a magazine. Also shown is a nail supply chute 35 that refills the magazine as nails 32 are drawn from the magazine and discharged by the nail gun 10. The force of gravity moves the nails 32 down the magazine to the nail head 11.

Figure 2:
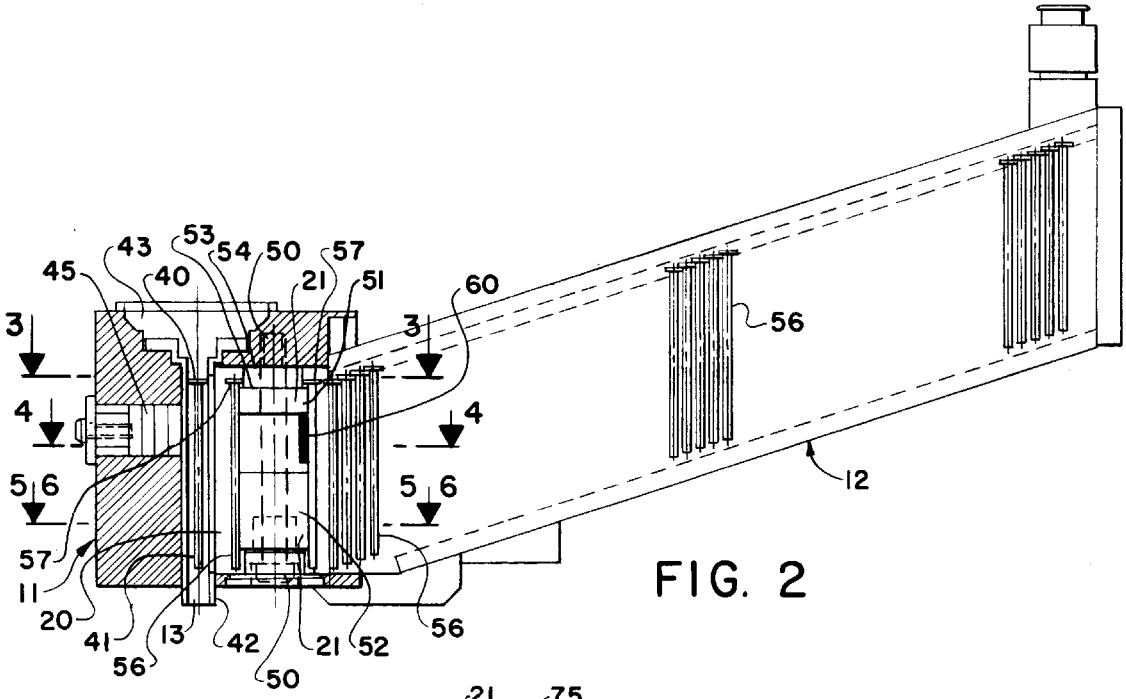
FIG. 2 is a side view, partially in cross-section of the embodiment of FIG. 1 and displays a nail source, nail head and nailing mechanism chamber of a nail gun.

FIG. 2 shows only the nail head 11 and the nail source 12. The firing chamber 13 includes a cylindrical bore that extends through the head 11. A piston (not shown) or other actuator from the automatic nailing gun (See FIG. 1) engages the head 40 of a nail 41 and drives the nail downwardly through the chamber 13 and into a manufacturing piece. The piston (not shown) then withdraws and allows a subsequent nail to be drawn into the firing chamber 13. Preferably, there is a stainless steel sleeve 42 lining the inside of the firing chamber 13. This sleeve 42 is placed inside the firing chamber 13 to reduce wear as a result of the constant movement of the piston through the chamber. At the top of the firing chamber 13 there is a machined out portion 43 to receive a nailing mechanism. This portion 43 may be custom designed to fit any type of automatic nailing gun. Approximately midway down the firing chamber 13 and adjacent the firing chamber, there is mounted within the head 11 a strong magnet 45 or extractor. This magnet 45 is designed to draw a nail into the firing chamber 13 and hold it onto the wall of the firing chamber before it is discharged.

FIG. 2 also shows the cylindrical turret that is mounted within the head 11. The turret 21 is mounted about a spindle 50 (shown in phantom lines) about which the turret rotates. The turret 21 is comprised of two circular disks 51, 52 mounted about each end of the spindle 50 spaced apart a distance less than the length of a nail. These disks 51, 52 have notches 55 (see FIGS. 3–6) adapted to receive and hold nails 56. The notches 55 extend in a direction parallel to the axis 22 around which the turret 21 rotates. The top disk 51 has a shoulder 53 and narrowed portion 54 so that a nail head 57 will not prevent a nail 56 from resting within the notch 55 defined by the outside diameter of the disk. The spindle 50 may be permanently joined and a part of the turret 21. Alternatively, the spindle 50 may be hollow to receive a bolt or pin that makes up the axis about which the turret 21 rotates. A bolt that is removable allows the turret 21 to be easily removed from the head 11.

There is also shown in FIG. 2 a magnet 60, also referred to as a retainer, that is mounted in the head 11 so that it is fixed within the outside diameter of the turret 21. This magnet 60, inboard from where the nails 56 are received in the notches 55 of the turret 21, provides the force for pulling nails into the notches on the turret as the turret rotates about its axis. These notches 55 are also referred to as nail holding stations. In other words, loose nails 56 slide down the magazine 12 adjacent the turret 21. The magnet 60 then draws the nail 56 into the notches 55 of the turret 21. The nails 56 are held in the turret 21 by the notches and further by the arcuate surface 65 defining the cylinder 20 in which the turret 21 is mounted. (See FIGS. 3–6). As the turret 21 rotates, the nail 56 cannot fall or slide out of the turret, because the arcuate surface 65 that is the inside of the cylinder 20 in the head 11 keeps the nails from escaping. The diameter of the arcuate surface 65 is preselected so that the nails 56 may rest in the notches 55 of the turret 21 and rotate freely around with the turret. The nail source or magazine 12 is designed to be oriented on an incline like that shown so that the nails 56 move down the magazine by gravity.

FIGS. 3 through 6 show various cross-sectional views of the head 11 which illustrate in detail the operation of the head and transfer device. The components shown in each figure are incorporated together on the preferred embodiment of the device.

Figure 3:
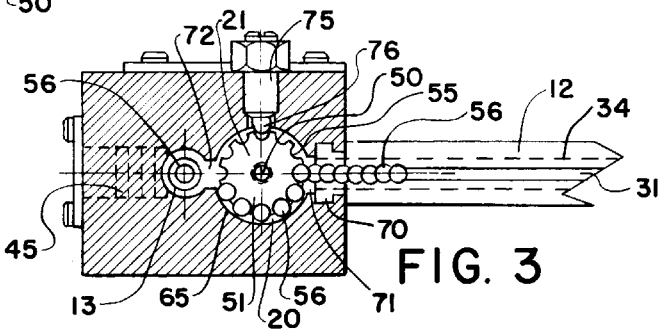
FIG. 3 is a top elevation taken along the lines 3—3 in FIG. 2.

FIG. 3 is a top elevation of the upper portion of the head 11. The magazine 12 is shown as having a slotted end 70 that fits into a machined out portion of the head. In this way, the magazine 12 may be removed to gain access to the head 11. The inlet 71 is an opening between the magazine 12 and the hollow cylinder 20 in the head 11. The inlet 71 has a width slightly greater than the maximum width of a nail head thereby allowing only a single nail to pass through the inlet at a time. Mounted in the hollow cylinder 20 is the turret 21. The outside diameter of the turret 21 is generally circular and is defined by small, semi-circular notches 55 in the outside diameter. The notches 55 on the turret 21 are adapted to receive nails 56. The spindle 50 is the central axis of the turret 21. The outlet 72 is an opening between the hollow cylinder 20 and the firing chamber 13. The outlet 72 is shown oriented exactly opposite the inlet 71. The width of the outlet 72 is slightly greater than the maximum width of a nail head, thereby allowing only one nail at a time to be drawn into the firing chamber 13. The magnet 45 on the opposite side of the firing chamber 13 from the outlet passage 72 draws the nail 56 from the turret 21 into the firing chamber. The arcuate inside edge 65 of the cylinder 20 in which is mounted the turret 21 is shown as having a diameter slightly greater than the diameter of the turret 21 when nails 56 are nested in the turret notches 55. A spring clip 75 is shown mounted in the head 11 and next to the turret 21 so that the tip 76 of the clip 75 protrudes into the notches 55 of the turret 21. As the turret 21 rotates about its axis, the tip 76 of the spring clip 75 moves in and out of the clip 75 thereby allowing the rotation of the turret 21 but holding the turret when there is no rotational force moving the turret. The spring clip 75 is placed on the cylinder 20 opposite the portion of the cylinder where the nails 56 are carried. In this way, the spring clip 75 does not disturb the carrying of the nails 56 in an undisturbed fashion in the turret 21.

Figure 4:
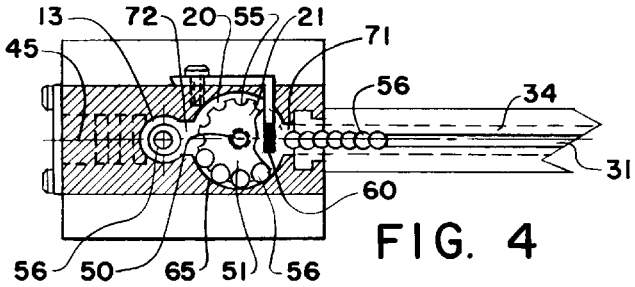
FIG. 4 is a top elevation taken along lines 4—4 in FIG. 2.

FIG. 4 is a further cross-sectional view of the head 11 in approximately the middle portion of the head as shown in lines 4—4 of FIG. 2. The magazine 12 is again shown with representative nails 56 in the magazine. Adjacent the inlet 71 is a first magnet 60. The first magnet 60 is within the outside diameter of the turret 21. In this way, the first magnet 60 draws a nail 56 from the magazine 12 into a notch 55 of the turret 21 and retains it there until the turret rotates about in a clockwise manner. When the turret 21 rotates, another nail 56 is drawn into the subsequent notch 55 that is presented at the inlet 71. On the opposite side of the cylinder 20, there is seen the outlet 72 which allows the nails 56 to be drawn from the turret 21 into the firing chamber 13 by a second magnet 45. The second magnet 45 mounted next to the firing chamber 13 is substantially stronger than the first magnet 60 that draws the nails 56 into the turret 21. Consequently, there is insufficient pull from the first magnet 60 to retain the nail 56 in the turret 21 once it is presented at the outlet 72.

The first magnet 60 is shown as a separate part from the turret 21. Alternatively, the turret 21 may itself be magnetized. In a further alternative, an integral or unitary portion of the turret such as the spindle or disks may be magnetized. No matter how this is accomplished, the magnetic force of the first magnet 60 must be sufficient to pull the nail into the turret 21, yet not so strong as to counter the pull of the second magnet 45 that draws the nail 56 into the firing chamber 13. Permanent rare earth magnets have been found to be acceptable for both the first and second magnets. For example, the first magnet 60 may be a NEO DYMIUM disk magnet having a diameter of three-quarters (¾) of an inch and a thickness of three-sixteenths (3⁄16) of an inch. The magnet has a pull force of about ten pounds. The second magnet 45 is a stack of four of the NEO DYMIUM disk magnets described above. One source for these magnets is the Miami Magnet Company. Those skilled in the art will be able to select other first and second magnets that accomplish the same purpose, the same way, to achieve the same results.

Figure 5:
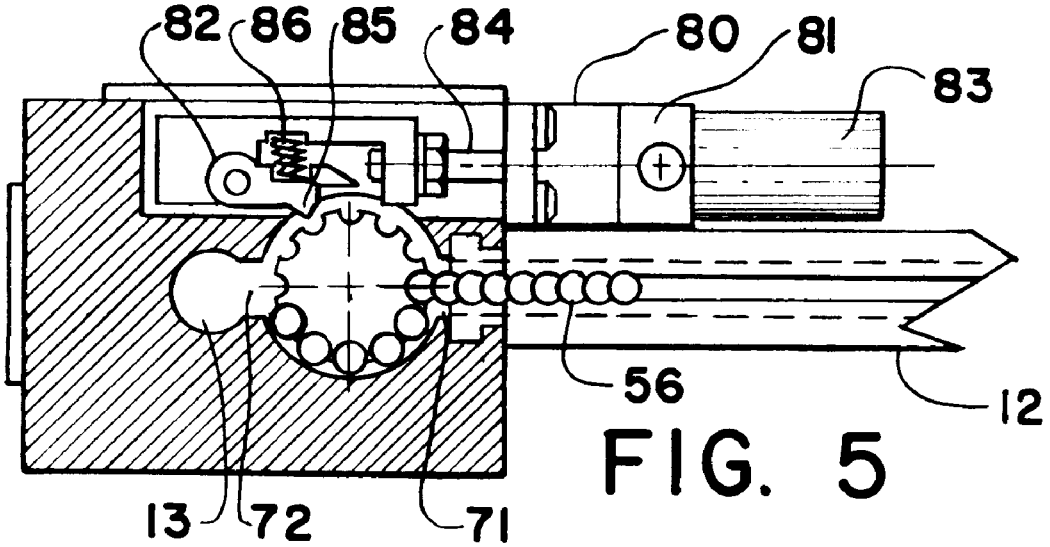
FIG. 5 is a top elevation taken along lines 5—5 in FIG. 2, the cycling indexer shown in one extended position.
Figure 6:
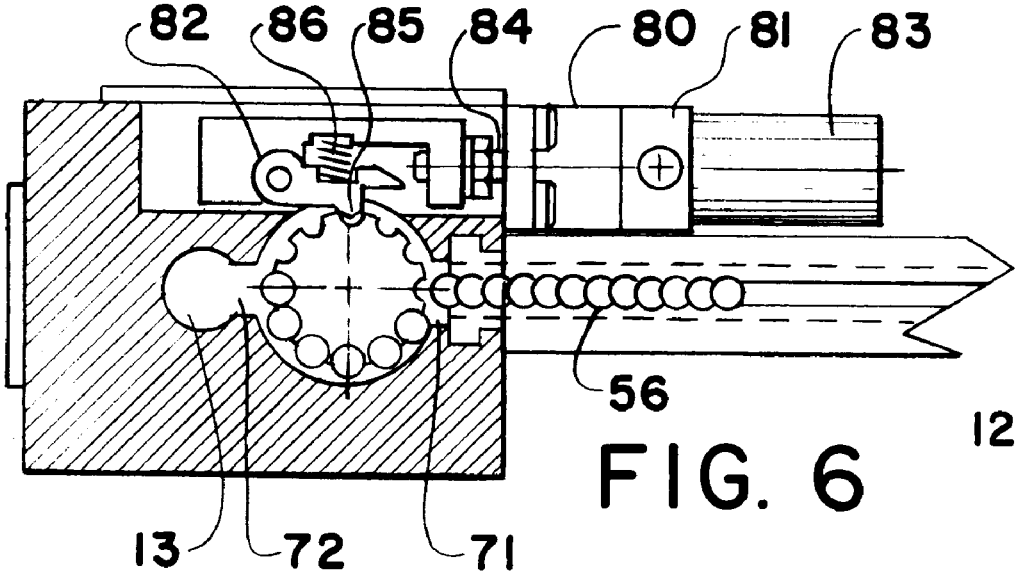
FIG. 6 is a top elevation taken along lines 6—6 in FIG. 2, the cycling indexer shown in its withdrawn position.

FIGS. 5 and 6 illustrate the cycling indexer 80 portion of the transfer device. FIGS. 5 and 6 show the lower portion of the head 11. There is shown the magazine 12 that provides the nails 56 to be fed into the turret 21. The cycling indexer 80 is comprised of a pneumatic actuator 81 and a pawl 82. The pneumatic actuator 81 is made up of a pneumatic cylinder 83 from which extends a piston 84. Attached to the end of the piston 84 is the pawl 82 which has a flexible pusher 85. When the pneumatic nail gun discharges a nail, this discharge actuates the pneumatic cylinder 83 to move the piston 84 in and out of the pneumatic cylinder. When the piston 84 is drawn into the pneumatic cylinder 83, the pusher 85 catches the inside edge of a notch 55 in the turret 21 and rotates it around a preselected distance. The distance is equal to the length of one notch 55 or one nail so that a single nail is presented at the outlet 72 to be drawn into the firing chamber 13 and a single nail is allowed to be drawn into the turret 21 from the inlet 71 of the turret. As the piston 84 extends from the pneumatic cylinder 83, a spring on the pusher 85 assembly compresses and the turret 21 does not move. The turret 21 is further held in place by the spring clip 75 illustrated and described in connection with FIG. 3. In operation, therefore, the pawl 82 comprises an assembly which reciprocates back and forth to advance the turret 21 in incremental steps where a single nail is presented in the outlet 72 to be drawn into the firing chamber 13. This ensures that only one nail at a time can be fired by the automatic nail gun. FIG. 5 shows the piston 84 in its extended position where the pusher 85 is disengaged from the turret 21. FIG. 6 shows the piston 84 in its withdrawn position where the pusher 85 has engaged the side of a notch 55 and advanced the turret 21 one position.

Turning now to FIGS. 7–10, there is shown an alternative embodiment of a transfer apparatus of the present invention. For some applications, the rotating turret discussed in connection with FIGS. 1–6 may be too bulky. In those cases where the rotating turret takes up too much space, the embodiment shown in FIGS. 7–10 may be used.

Figure 7:
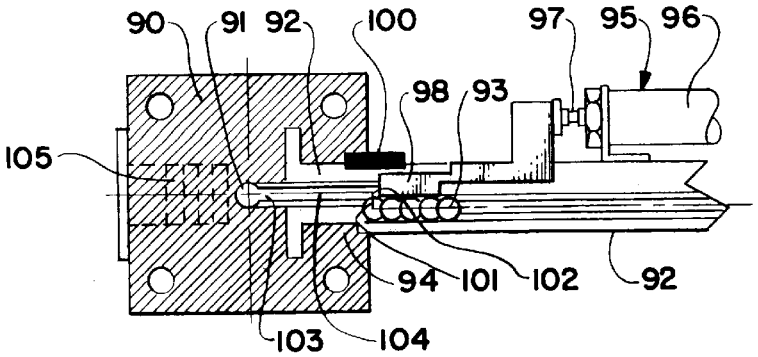
FIGS. 7—10 are top elevations showing sequential operation of another embodiment of the present invention.

In FIG. 7, there is shown a nail head 90 that is fixed between the nailing mechanism (not shown) and the nail source 92. The nail head 90 is comprised of a firing chamber 91. The nail head 90 also defines a slot 94 which is shaped to engage the end of the nail source 92. The nail source 92 is also referred to as a magazine and operates to present a supply of nails 93 to the nail transfer apparatus.

Adjacent the end of the nail source 92 is a cycling indexer 95. The cycling indexer 95 is comprised of a pneumatic cylinder 96, a piston 97 that moves into and out of the pneumatic cylinder, and a sweeper 98 that is connected to the piston 97 and moves back and forth as the piston moves into and out of the cylinder.

Also located at the end of the source 92 is a transfer passage 104. The transfer passage 104 is the passage between the firing chamber 91 and the source 92. There is an inlet 101 that is an opening between the source 92 and the transfer passage 104 that allows nails 93 to move from the source into the transfer passage. Further, there is an outlet 103 that is an opening between the transfer passage 104 and the firing chamber 91 that allows for the dispensing of nails 93 to the firing chamber.

The transfer passage 104 is further comprised of a nail holding station 102 that is the portion of the transfer passage located adjacent a retainer 100. The retainer 100 is fixed on the side of the transfer passage 104 opposite the inlet 101. The retainer 100 releasably holds a nail 93 in the nail holding station 102. In a preferred embodiment, the retainer 100 is a magnet.

At the outlet 103 there is an extractor 105 for removing a nail 93 from the transfer passage 104 and through the outlet 103 for dispensing into the firing chamber 91 of an automatic nail gun. In the embodiment of FIGS. 7–10, the extractor 105 is a magnet.

The retainer 100, which in the illustrated embodiments is a magnet, is chosen to have a first force of a selected magnitude great enough to pull a nail 93 into the transfer passage 104, and specifically the holding station 102, and releasably hold it there. This force must not be so great as to prevent the sweeper 98 from moving back and forth and pushing nails 93 through the transfer chamber 104. The extractor 105, also a magnet in the illustrated embodiment, has a second force sufficient to pull a nail 93 from the transfer passage 104 through the outlet 103 and into the firing chamber 91. The earlier discussion regarding appropriate magnets applies equally to the selection of magnets to be used in this embodiment.

Figure 8:
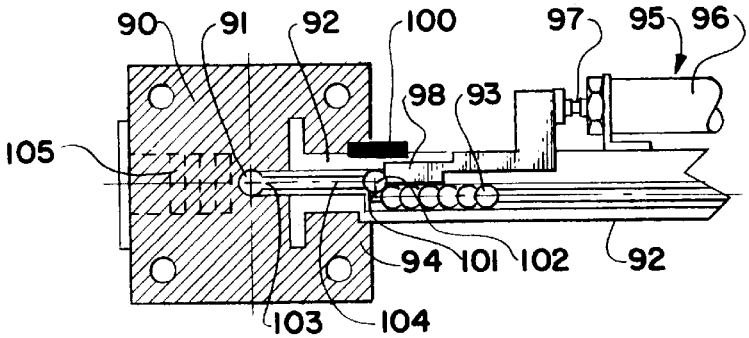
Figure 9:
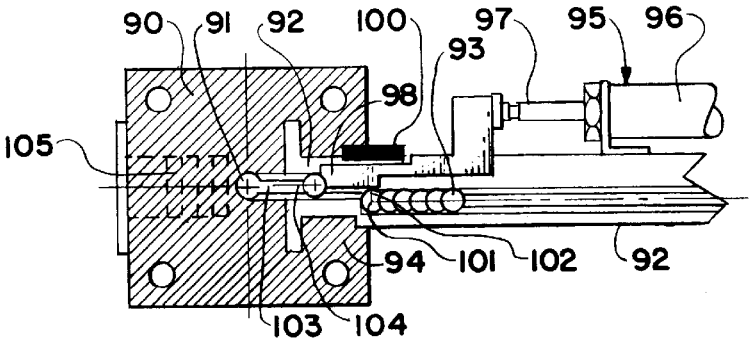
Figure 10:
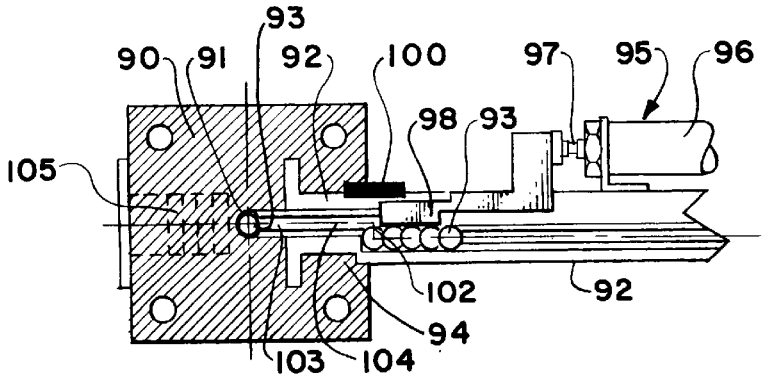

In operation, the cycling indexer 95 works in coordination with the nailing mechanism. Nails 93 are fed through the magazine 92. At the end of the magazine 92, nails 93 are presented one at a time into the transfer passage 104, because the width of the inlet 101 is only wide enough to allow one nail at a time to pass through into the transfer passage. When the cycling indexer 95 is in the fully retracted position, as shown in FIG. 7, a nail 93 is pulled into the nail holding position 102 by the retainer 100, as shown in FIG. 8. The cycling indexer 95 then moves into its fully extended position, see FIG. 9, with each cycle of the nailing mechanism. The sweeper 98 pushes the nail off of the retainer 100 and presents the nail at the outlet 103 where the extractor 105 pulls the nail 93 into the firing chamber 91. The sweeper 98 itself blocks off the inlet 101 except in the fully retracted position, so only one nail 93 at a time is in the transfer passage 104. FIG. 10 shows a nail 93 in the firing chamber 91 and the cycling indexer 95 in the fully retracted position, thus ready to allow another nail to pass through the inlet 101 to be retained in the nail holding position 102.

The transfer passage 104 discussed in connection with FIGS. 7–10 accomplishes the same purpose as the rotating turret 21 inside the cylinder 20 shown in FIGS. 1–6. They are both transfer passages contemplated by the present invention. Further, the relative dimensions shown in the drawings are merely to illustrate the disclosed embodiments. Different lengths or shapes of the transfer passage may be adopted by one of skill in the art based on the teachings of the disclosure herein.

Although the invention has been described in connection with preferred embodiments thereof, it will be appreciated by those skilled in the art that additions, deletions, modifications, and substitutions may be made without departing from the spirit and scope of the invention as defined in the appended claims.

That which is claimed is:

1. An automatic nail gun comprising a nail source, a nail head and a nailing mechanism, the nail head comprising a hollow cylinder disposed between the nail source and the nailing mechanism, a cylindrical turret mounted inside the cylinder, and a cycling indexer, the cylinder comprising an inlet and an outlet wherein the inlet is an opening that is in communication with the nail source and allows the movement of nails from the nail source into the cylinder, and wherein the outlet is an opening that is in communication with the nailing mechanism and allows the movement of nails from inside the cylinder into the nailing mechanism, the turret being rotatable inside the cylinder, and having an outside diameter that defines notches adapted to carry nails, a first magnet mounted within the outside diameter of the turret and adjacent the inlet, a second magnet mounted in the nailing mechanism and adjacent the outlet, wherein the second magnet is stronger than the first magnet, and the cycling indexer actuating the rotation of the turret so that a single nail at a time is drawn into the nail head from the nail source and another single nail at a time is drawn into the nailing mechanism from the nail head;

the nailing mechanism being mounted onto the nail head and comprising a firing means for causing a nail to be discharged from the nailing mechanism.

2. The automatic nail gun described in claim 1 wherein the turret is comprised of parallel disks mounted about a spindle passing through the center of the disks and wherein the disks are spaced apart a distance less than the length of a nail and further wherein the spindle is the axis about which the turret rotates.

3. The automatic nail gun described in claim 1 wherein the inlet and outlet are oriented directly across from each other on opposite sides of the cylinder.

4. The automatic nail gun described in claim 1 wherein the nail source is a magazine comprised of a tubular body with a longitudinal slot through its length that carries nails by supporting the heads of the nails along a longitudinal pair of parallel guideways defined by the longitudinal slot in the magazine.

5. The automatic nail gun described in claim 4 wherein the guideways are inclined downwardly towards the nail head to promote the movement by gravity of nails toward the nail head.

6. A nail transfer device for transferring nails from a nail source to an automatic nail gun, the device comprising:

an inlet for receiving nails from the source and an outlet adapted to dispense nails to the automatic gun;

a transfer passage disposed between the inlet and outlet, the transfer passage having an individual nail holding station therein for receiving one nail at a time from the inlet;

a retainer releasably holding a nail to the nail holding station with a first force of a selected magnitude, wherein the retainer is comprised of a first magnetic material and wherein the first force is a magnetic force;

a cycling indexer for transferring a nail from the nail holding station to the outlet; and an extractor at the outlet exerting a second force on the nail, the second force being sufficient to remove the nail from the transfer passage and through the outlet for dispensing to the automatic nail gun.

7. The nail transfer device of claim 6 wherein the transfer passage comprises at least two nail holding stations wherein one nail holding station receives a nail from the inlet while the other nail holding station releases a nail to the outlet.

8. The nail transfer device of claim 6 wherein the transfer passage comprises a turret rotatable about an axis by the cycling indexer.

9. The nail transfer device of claim 8 wherein the rotatable turret has a plurality of nail holding stations.

10. The nail transfer device of claim 9 wherein the nail holding stations are notches.

11. The nail transfer device of claim 10 wherein the notches extend in a direction parallel to the axis around which the turret rotates.

12. The nail transfer device of claim 11 wherein the magnetic material is integral with the turret.

13. The nail transfer device of claim 11 wherein the magnetic material is unitary with the turret.

14. The nail transfer device of claim 11 wherein the magnetic material is separate from the turret and disposed inboard of the notches for initially attracting the nails into the notches.

15. The nail transfer device of claim 14 further including a cylinder having an inner arcuate surface surrounding at least a portion of the turret to hold the nails in the notches as the turret rotates.

16. The nail transfer device of claim 15 wherein the inlet is an opening through the arcuate surface having dimensions which allow only one nail at a time through to the turret.

17. The nail transfer device of claim 16 wherein the extractor is comprised of a second magnetic material disposed adjacent to the outlet and wherein the second force is a magnetic force.

18. The nail transfer device of claim 17 wherein the second magnetic material is contained in a magnet positioned outside of and spaced from the outlet by a distance sufficient to receive a nail into the firing chamber of a nail gun.

19. A nail transfer device for transferring nails from a nail gun source to an automatic nail gun, the device comprising: an inlet and an outlet with a transfer passage disposed therebetween; a cycling indexer for transferring nails one at a time from the inlet to the outlet; a first magnet for drawing the nails from the inlet to the transfer passage, and a second magnet adjacent to the outlet for dislodging the nails from the transfer passage and loading the nail into the automatic nail gun.

* * * * *